US005417604A

United States Patent [19]

Rafelman et al.

[11] Patent Number: 5,417,604

[45] Date of Patent: May 23, 1995

[54] KIT SUITABLE FOR FORMING DECORATIVE SIGNS

[75] Inventors: Andrew Rafelman, Willowdale; Sheldon B. Kerzner, Thornhill, both of Canada

[73] Assignee: Noma Inc., Scarborough, Canada

[21] Appl. No.: 250,321

[22] Filed: May 27, 1994

Related U.S. Application Data

[63] Continuation of Ser. No. 37,837, Mar. 29, 1993, abandoned.

[51] Int. Cl.[6] ..... A63H 33/08; A63F 3/00; G09B 1/36; G09F 7/16

[52] U.S. Cl. ..... 446/124; 446/98; 446/901; 273/282.1; 273/290; 434/171; 434/172; 40/595; 40/594

[58] Field of Search ..... 446/124; 434/171, 172; 273/282.1, 290

[56] References Cited

U.S. PATENT DOCUMENTS 3,805,426 4/1974 Cunningham ..... 238/39
3,959,906 6/1976 Norris, Jr. et al. ..... 40/595
4,529,385 7/1985 Reiner et al. ..... 446/127

*Primary Examiner*—Robert A. Hafer
*Assistant Examiner*—Michael O'Neill
*Attorney, Agent, or Firm*—Kenneth M. Garrett

[57] ABSTRACT

A modular constructional toy kit for use in forming signs is made up of modular elements, each of which comprises a body portion having a planar forwardly facing surface with a bounding periphery having a regular geometric shape, and coupling elements for coupling the modular elements together with the planar surfaces generally residing in a plane and the body portions in side by side relationship. A set of e.g. alphabetic characters is provided, each character being arranged on a discrete portion of planar sheet material bounded by a margin complementary to the periphery of the body portion. Preferably the characters are die cut on the discrete portions of sheet material so as to form the character and at the same time a reverse character, either of which may be applied to the planar surface of the modular elements.

5 Claims, 1 Drawing Sheet

KIT SUITABLE FOR FORMING DECORATIVE SIGNS

CROSS REFERENCE TO RELATED APPLICATION

This application is a continuation of Ser. No. 08/037,837 filed Mar. 29, 1993 which is abandon.

FIELD OF INVENTION

This invention relates to a modular constructional toy kit having a utility in forming signs, although it is not necessarily limited thereto.

BACKGROUND OF THE INVENTION

Signs are known made up from modular elements each comprising a body portion having a generally planar forwardly facing surface, and means integral with each modular element for joining the element to a similar element with the body portions residing generally in side-by-side relationship and the forwardly facing surfaces generally residing in the same plane. The message to be conveyed by these signs is painted thereon, usually with one letter of the alphabet on each forwardly facing surface. This arrangement is relatively inflexible, and does not readily permit individuals to make up a variety of signs from the modular elements.

SUMMARY OF INVENTION

In accordance with this invention, a kit for making signs and decorations comprises a plurality of the aforementioned modular elements, in each of which the forwardly facing surface has a bounding periphery of regular geometric shape. It should be understood that this bounding periphery may be formed by the bounding edge of the forward face, such edge being formed at the intersection of the forward face with side faces, or it may be within this bounding edge, and be demarked by any convenient means. The kit also includes a plurality of discrete portions of planar sheet material bounded by a margin complementary to the bounding periphery of the forwardly facing surface. Each of the discrete portions of planar sheet material has an indicium thereon, and means is provided for securing the indicium to the forward facing surface. Accordingly, the flexibility of the modules in making different signs is greatly increased.

The planar sheet material is suitably provided with a self adhesive substrate which serves as a means for securing the indicium to the forwardly facing surface; a release paper will normally cover the adhesive substrate until such time as it is desired to adhere the indicium to the forwardly facing surface.

The indicium is preferably formed by die cutting the sheet material within the margin thereof, to form a reverse form of the indicium and simultaneously therewith, a complementary form of the indicium, the release paper serving to maintain the reverse form indicium and the complementary form indicium in nested relationship.

When the reverse form indicium is applied to a forwardly facing surface, the indicium is perceived in the colour of the forwardly facing surface surrounded by the background colour of the sheet material. When the complementary form indicium is applied to the forwardly facing surface, the indicium is perceived in the colour of the sheet material, surrounded by a background colour of the surface.

It will be understood that the sheet material and the forwardly facing surface within the bounding periphery will be differently coloured.

In accordance with the illustrative embodiment, the indicia are alphabetic characters. Assuming the use of a kit by a child to form a name, most names or the diminutive thereof will be formable by four letters, and it will be rare that in such name the same letter will be used more than twice. Accordingly, twenty-six portions of the planar sheet material will provide twenty-six reverse form indicia and corresponding twenty-six complementary form indicia, and will usually suffice to permit most proper names or simple common nouns to be formed.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
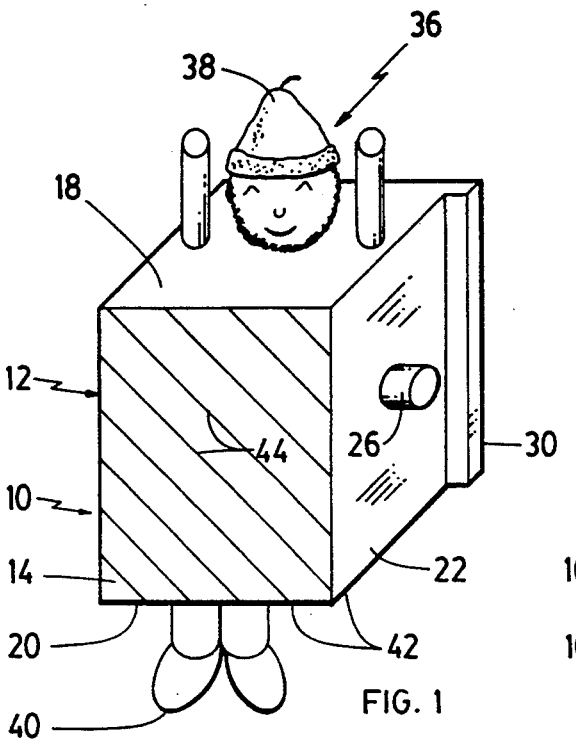
FIG. 1 shows a modular element forming a part of the kit of the invention in perspective view from the front.
Figure 2:
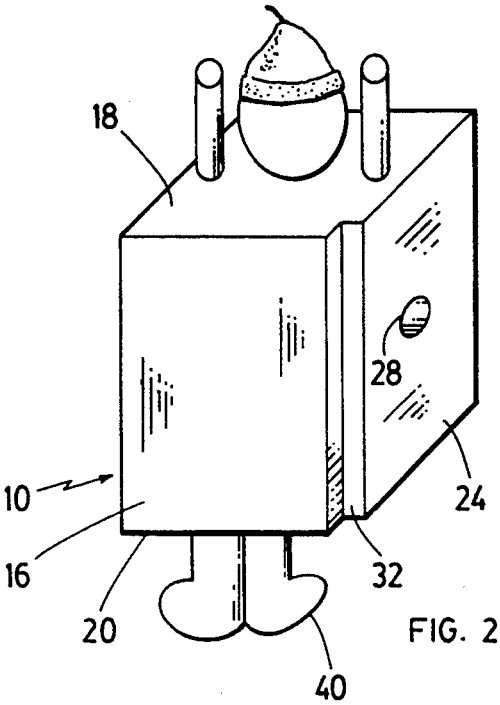
FIG. 2 shows the element of FIG. 1 in perspective view from the rear.
Figure 4:
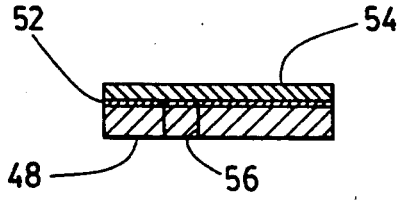
FIG. 4 shows a cross section along line 4—4 of FIG. 3, with the thickness greatly enlarged to show structural detail.
Figure 3:
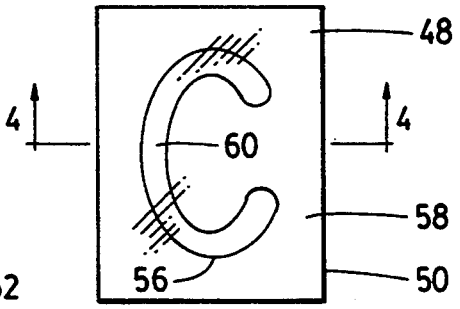
FIG. 3 shows an indicium forming a part of the kit of the invention.
Figure 5:
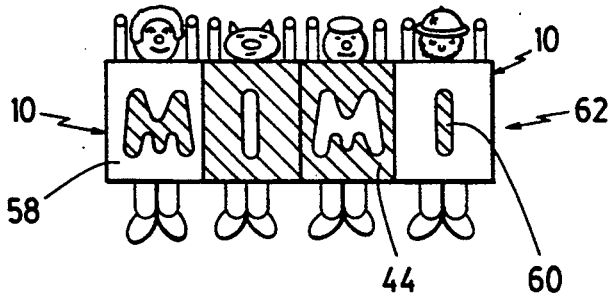
FIG. 5 shows a sign constructed from the kit.

Referring to the drawings in detail, a modular element forming part of a kit for use in constructing a decorative sign is identified generally by the numeral 10. Element 10 comprises a generally rectangular prismatic body portion 12 having a forward face 14 and a rear face 16 which interconnected by top and bottom faces 18,20 and opposed side faces 22,24. Side face 22 is provided with a centrally located dowel 26 which projects outwardly therefrom. Side face 24 is provided with an opening 28 into which dowel 26 is receivable to couple adjacent elements 10 together in a repeating linear manner. Side face 22 is also provided with a small tenon 30 and side face 24 with a groove 32 into which the tenon 30 of an adjacent element 10 is received when two elements are coupled together, which prevents the rotation of one element about the dowel 26 of an adjacent element, and retains the forward face 14 of adjacent coupled elements within the same plane.

Element 10 is in the form of a humanoid FIG. 36, for which body portion 12 serves as the body, and which include a head 38 which projects from top face 18 and feet 40 which project from bottom face 20, thereby adding visual interest to signs constructed from the elements 10. Additionally, feet 40 serve to support a sign constructed from modular elements 10 as will be subsequently referred to. As thus far described, elements 10 are known in the art, as are signs constructed therefrom wherein letters are painted onto the forward face 14 of the bodies 12.

The forward face 14 of body portion 12 is bounded by its physical edge 42 formed by the intersection of face 14 and walls 18,20,22,24, which edge is this instance also forms a bounding periphery within which an indicium is to be applied, as will be subsequently described. The forward face 14 within the bounding periphery 42 of the face is uniformly coloured, shown as hatching 44. The forward face 14 of other similar modular elements 10 forming part of the kit may be identically coloured, or differently coloured, this being a matter primarily of aesthetic preference.

The modular kit further comprises a plurality of discrete portions of sheet material 48 (only one being shown) each having a bounding margin 50 which is complementary to that of bounding periphery 42. Sheet material 48 is coloured uniformly and differently from the colour of the face 14 of .any of the modular elements 10 forming part of the kit. Sheet material 48 is coated on the reverse side thereof with a self adhesive substrate 52 which is in turn covered by a release paper 54.

Sheet material 48 is die cut at 56, without intersecting the bounding margin 50 of the sheet material, to form an indicium 58 in the form of a reverse letter, and simultaneously therewith to form a complementary form indicium 60. In the die cutting process, release paper 54 is not cut, whereby it serves to retain the reverse form indicium 58 and the complementary form indicium 60 in nested relationship until such time as it is desired to alphabetise the modular elements 10 to form a sign 62. It will be appreciated from the foregoing description that either the reverse form indicium 58 or the complementary form indicium 60 can be applied to alphabetise forward face 14. Thus, as seen in relation to sign 62, the first occurrence of the letter M is formed by applying reverse form indicium 58 in the form of a reverse letter "M" to the first modular element 10 of the sequence, whereby the contrasting colour 44 of the forward face 14 is perceived as the selected letter; for the second occurrence of the letter M, the complementary indicium form 60 of the letter "M" is applied to face 14 of the third modular element 10 of the sequence, the letter then being perceived against the contrasting background colour 44 of the forward face.

It will be apparent that many changes may be made to the illustrative embodiment while falling within the scope of the invention, and it is intended that all such changes be covered by the claims appended hereto.

We claim:

1. A modular constructional toy kit for use in forming signs comprising a plurality of modular elements, each of said modular elements comprising a body portion having a planar forwardly facing surface with a bounding periphery having a regular geometric shape, means integral with each said modular element for coupling said modular element to another said modular element with said planar surfaces generally residing in a plane and said body portions in side by side relationship;

a plurality of portions of planar sheet material each having a self adhesive substrate and a release paper covering said substrate;

each of said portions having a bounding margin to fit within the bounding periphery of said forwardly facing surface;

each of said portions being die cut to form within the bounding margin thereof an indicium in reverse form and nested therein an indicium of complementary form;

said reverse form indicium and said complementary form indicium being retained together in their nested relationship by said release paper;

said sheet material and said forwardly facing surface having contrasting colours;

whereby either said reverse form indicium or said complementary form indicium is adhered to said forwardly facing surface within said founding periphery thereof to form a message or part thereof.

2. A modular toy as defined in claim 1, wherein said indicium is an alphabetic character.

3. A modular toy as defined in claim 1, wherein said body portion is generally in the form of a rectangular prism.

4. A modular toy as defined in claim 1, wherein said elements are each in the form of a humanoid figure, and wherein said body portion forms the body of a said humanoid figure.

5. A modular toy as defined in claim 4, wherein said humanoid figure includes feet, and wherein said feet serve as a base for supporting said modular elements from a support surface.

* * * * *